US005582542A

United States Patent [19]

Stein

[11] Patent Number: 5,582,542

[45] Date of Patent: Dec. 10, 1996

[54] APPARATUS AND METHOD FOR SHARPENING A CUTTING TOOL

[76] Inventor: Sanford Stein, 2411 Graham Ave., Redondo Beach, Calif. 90278

[21] Appl. No.: 287,500

[22] Filed: Aug. 8, 1994

[51] Int. Cl.[6] ..... B24B 19/00

[52] U.S. Cl. ..... 451/367; 451/380; 451/391; 451/405

[58] Field of Search ..... 451/278, 349, 451/365, 367, 369, 378, 380, 386, 387, 391, 405, 552, 555, 557, 558

[56] References Cited

U.S. PATENT DOCUMENTS

| | | | |
|---|---|---|---|
| 901,059 | 10/1908 | Ball | 451/369 |
| 1,091,074 | 3/1914 | Moore | 451/367 |
| 1,652,469 | 12/1927 | Dodge | 451/380 |
| 2,153,476 | 4/1939 | Norman | 451/365 |
| 2,644,279 | 7/1953 | Stankovich | 451/380 |
| 2,902,801 | 9/1959 | Callaghan | 451/369 |
| 4,078,338 | 3/1978 | Baughcom | 451/378 |
| 4,217,735 | 8/1980 | McGeoch | 451/387 |

*Primary Examiner*—Robert C. Watson
*Assistant Examiner*—Thomas W. Lynch
*Attorney, Agent, or Firm*—Irving Keschner

[57] ABSTRACT

An apparatus and method for sharpening a cutting tool, including the grinding and honing of the cutting tool is described and illustrated. The apparatus comprises a base plate with a biasing frame mounted on the base plate. A tool holder is clamped to the biasing frame and releasably clamps a cutting tool, having an edge which is to be sharpened. A variety of tool holders allow the sharpening of different types of cutting tools. The cutting tool, and particularly, the edge thereof, is held in a stationary position and an abrasive member is moved with respect to the cutting edge of the tool. The apparatus forces the cutting edge of the tool against the abrasive member with a uniform amount of pressure and at a selected angle. Both the pressure and the selected angle are easily adjustable by the user. When the major variables, such as angle of sharpening and the pressure between the abrasive element and tool are fixed, an accurate, correct and reproducible sharpening will occur. A precise sharpening of the tool will automatically result since only the abrasive stone is moved back and forth across the base plate under the cutting edge of the tool.

2 Claims, 3 Drawing Sheets

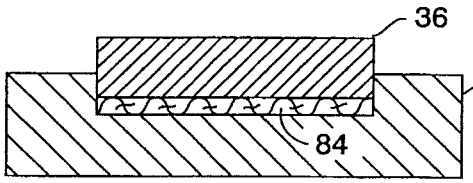
FIG.7
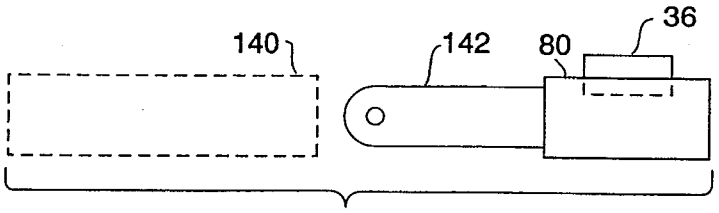
FIG. 8
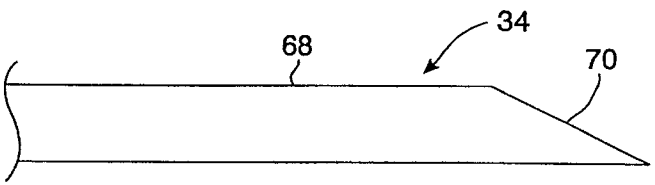
FIG.10
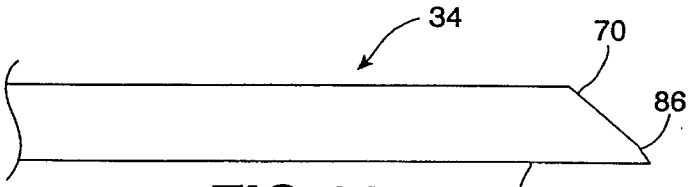
FIG.11
FIG.6
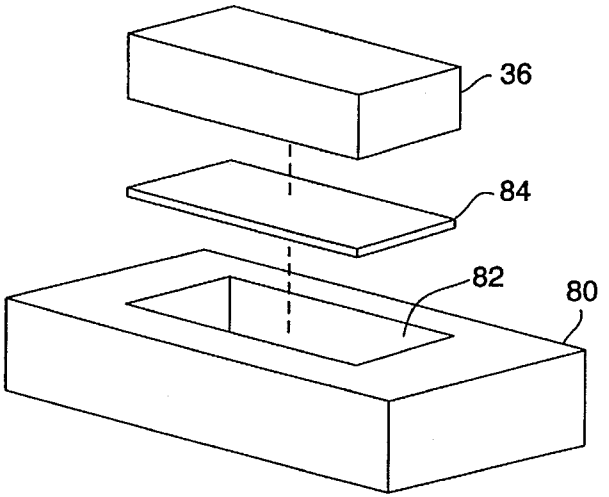
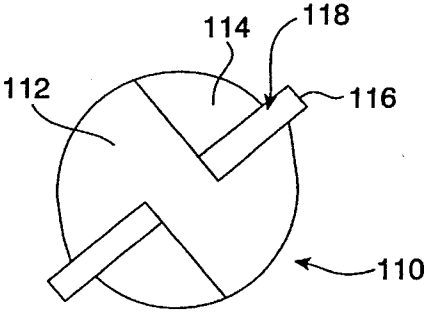
FIG.9

APPARATUS AND METHOD FOR SHARPENING A CUTTING TOOL

BACKGROUND OF THE INVENTION

1. Field of the Invention

This invention relates in general to certain new and useful improvements in both an apparatus and a method for sharpening a cutting tool. More particularly, the invention relates to a device of the type for sharpening a cutting tool by shifting an abrasive element under the tool's cutting edge. The tool is adjustably clamped at a selected angle and with a uniform pressure between the tool and an abrasive element, while the abrasive element is shifted back and forth by the user. This invention enables a precise and accurate sharpening of the tool by an inexperienced user.

2. Brief Description of the Prior Art

Cutting tools, and particularly, those used in wood cutting machinery, such as routers, thickness planers and the like, frequently require sharpening or honing and, to some extent, may even require grinding. The same holds true of many hand-held cutting tools and particularly wood cutting tools, such as chisels and the like. The present state of the art usually resides in manually holding the cutting tool and bringing the same into contact with a rotating abrasive element, such as a grinding wheel, or otherwise, by manually moving the cutting tool against a fixed abrasive element such as a sharpening stone.

For the manufacturer of cutting tools, the sharpening of the tool is a relatively simple task, when the necessary and very costly machinery is available. However, for the users of these cutting tools who do not have the availability of this very expensive and highly technical sharpening machinery, the task of sharpening a tool to obtain a precise cutting edge becomes rather difficult. In order to obtain proper cutting with a tool, it is necessary to maintain a uniform cutting edge on the tool. Moreover, the uniformity of this edge is desirably duplicated on each occasion when the tool is sharpened. When a tool is hand-held and brought into contact with an abrasive element, or when the abrasive element is hand-held and brought into contact with the tool by some manual means, precision of the cutting angle and uniformity of the cutting edge is materially sacrificed.

Conventional bench grinding wheels which usually comprise an abrasive stone rotated by an electric motor arrangement have been used for sharpening. In this case, the tool is physically held into contact with the rotating abrasive stone. However, and here again, it can be seen that this is a very rudimentary and non-precise way of sharpening a tool.

There are devices which function in the nature of a guide for sharpening chisels and plane blades. In one case, a frame holds the chisel or plane blade in relation to a fixed abrasive stone. The frame is somewhat L-shaped and utilizes a roller at one end for riding on a table or other supporting surface while the chisel or plane blade is clamped to the other end of the frame and extends into contact with the abrasive stone. One of the ostensible purposes of this device is to achieve a precise angle of the cutting edge. However, when manually moving a tool in contact with an abrasive stone, there is nothing to preclude a rockable movement and there is no means to obtain a predetermined sharpening pressure which is uniform from edge to edge of the tool.

Another prior art device clamps a chisel or plane blade and is provided with a roller for riding directly on the surface of the abrasive stone and the cutting edge of the tool is brought into contact with the abrasive stone as the device is moved along the stone. However, there is no means to obtain a constant uniform pressure when the tool is moved by hand across and against an abrasive stone. Still another prior art device allows the change of a honing angle for microbevel sharpening without removing the tool from a guide. Nevertheless, there is also no means to maintain a uniform pressure when moving the tool by hand.

An experienced craftsman can sharpen a cutting tool quite accurately. Unfortunately, most people are not experienced craftsmen.

Holding a cutting tool and bringing the same into contact with an abrasive element, as shown in the prior art devices, is a very archaic and inaccurate way to grind, sharpen or hone a tool. Usually, the party holding the tool or the abrasive element or moving one relative to the other, cannot hold and move the tool or abrasive element with a uniformity of pressure and angle of attack in order to ensure that there is a linear cut which is uniform across the length of the cutting edge of the tool. Moreover, it is virtually impossible to obtain a constant and uniform pressure between the tool and the abrasive element by manually holding one or the other and this desired consistency and uniformity of sharpening is sacrificed.

It can be seen that there have been several apparatus which employ a stationary abrasive element and which allows the cutting tool to be brought into contact with and moved across the abrasive element. In all such cases, there is no inexpensive device which enables a cutting tool to have a cutting edge sharpened with precise uniformity and at a correct cutting angle across the cutting edge and with uniformity from one sharpening to the next. In addition, there has not been any low-cost device which enables the sharpening of a secondary or microbevel on the tip of a cutting tool with precise uniformity and angle.

There are no simple devices for sharpening tools such as router bits, shaper cutters and similar tools. The usual way of sharpening these tools is by holding the bit or tool by hand and moving it back and forth on a hone or otherwise, by moving the hone against the bit or tool. Further, there are no effective and low cost devices which allow for the sharpening of solid carbide and carbide-tipped cutting members.

There has been a need for an inexpensive and effective apparatus which allows an inexperienced user to sharpen a cutting tool reliably. However, this can be accomplished in accordance with the present invention by the user moving the abrasive stone back and forth under the cutting edge of the tool. When the tool is properly positioned in the apparatus, the apparatus will keep the angle and the amount of pressure between the cutting edge of the tool and the stone fixed thereby yielding correctly sharpened tools.

OBJECTS OF THE INVENTION

It is, therefore, one of the primary objects of the present invention to provide an apparatus for sharpening a cutting tool with a high degree of uniformity and linearity in the cutting edge.

It is another object of the present invention to provide an apparatus of the type stated which utilizes a clamping mechanism for holding a tool of the type which is to be sharpened and bringing same into contact with an abrasive stone with a constant, but uniform pressure existing between the tool and the stone.

It is yet another object of the present invention to provide an apparatus that can sharpen various and diverse types of cutting tools which have a straight cutting edge.

It is a further object of the present invention to provide an apparatus of the type stated which utilizes a clamping mechanism for holding a tool to be sharpened in contact with an abrasive stone at a precise predetermined angle in order to obtain a desired predetermined cutting edge on the tool.

It is an additional object of the present invention to provide an apparatus of the type stated which allows for adjustability of the pressure between the tool and the stone and which also allows for adjustability of the angle of sharpening which exists between the cutting edge of the tool and the abrasive stone.

It is still another object of the present invention to provide an apparatus of the type stated which is highly effective in its operation and which is relatively simple in its construction.

It is also an object of the present invention to provide an apparatus of the type stated which can be manufactured at a relatively low cost.

It is another salient object of the present invention to provide a method for sharpening a cutting tool by producing a constant pressure between the entire cutting edge of the tool and the abrasive element and by using a precisely fixed preselected angle with respect to the abrasive element.

One object of the present invention is to provide an apparatus that is easy to use and can sharpen various tools. After properly positioning the tool, the user needs only to push the abrasive element back and forth under the cutting edge of the tool to be sharpened.

With the above and other objects in view, my invention resides in the novel features of form, construction, arrangement and combination of parts presently described and pointed out in the claims.

BRIEF SUMMARY OF THE INVENTION

This invention relates in general to an apparatus for sharpening a cutting tool The term "sharpening", as used in this present document, is used in a generic sense to include acts of honing and grinding, as well. Generally, sharpening refers to any activity which results in the cutting edge of the tool having a razor-sharp cutting edge. Grinding is also a sharpening activity, although it usually relates more to the coarse removal of material on the tool in order to obtain the cutting edge. "Honing", on the other hand, refers to a relatively fine sharpening of the edge of the tool. However, as indicated, in all such cases, the activity which results in removal of the material at the cutting edge in order to obtain a razor-sharp edge, will be deemed to be a sharpening of that edge.

The term "cutting tool" is used to refer to all types of tools which will result in the removal of material from the member which is being cut as, for example, the removal of wood from a wood block, either by a router, a chisel, plane or the like. In many cases, the activity of cutting actually constitutes a shaving of the material being cut. Nevertheless, this is also deemed to be cutting in the context of the present invention.

The invention is primarily useful, although not specifically limited to the sharpening, grinding and honing of a wood cutting tool, such as a chisel, a router bit or the like. The invention is also highly effective in the sharpening of a tool used in the cutting of plastics and other materials, including some soft metals. Thus, the term "cutting tool" is used herein in a broad sense to include all types of tools which will cut or shave, or otherwise remove material from a work-piece.

Some of the tools which can be sharpened with the apparatus and the method of the present invention include, but are not limited to, hand chisels, hand plane blades, router bits, shaper cutters, molding cutter bits, jointer knives, thickness planer knives, etc. Further, it is possible to sharpen solid carbide or carbide-tipped cutting edges using diamond hones with the apparatus and method of the present invention.

The abrasive stone may be a grinding wheel or a natural or man-made stone, or a diamond hone. Thus, the term "abrasive stone" or "abrasive element" is used herein in a broad sense to include all types of materials used to sharpen tools.

The apparatus of the invention comprises a base plate to which a biasing frame is mounted. A tool holder is mounted on a forward end of the biasing frame and is designed to releasably clamp a cutting tool, having an edge which is to be sharpened. In this way, the tool is positioned so that it can be accurately and evenly sharpened with an abrasive element, such as an abrasive stone. The abrasive stone can be moved back and forth on the base plate with or without a stone holder, as hereinafter described.

The apparatus is constructed so that the biasing frame is provided with a spring-like action to force the cutting edge of the tool into contact with the abrasive element with a predetermined amount of pressure. More importantly, the pressure is constant and uniform along the entire cutting edge of the tool in each sharpening operation, due to the fact that the cutting edge of the tool is forced into contact with the abrasive stone by a uniform spring-biasing force. In an important aspect of the present invention, however, the amount of pressure which is imposed on the cutting edge of the tool as it is forced onto the abrasive stone, can be adjusted and changed from sharpening operation to sharpening operation.

The tool holder is adjustably positionable with respect to the biasing frame so as to adjust the angle of the cutting edge of the tool with respect to the abrasive element. In this case, the angle of attack, that is, the angle in which the cutting edge of the tool engages the surface of the abrasive element, can also be adjusted in order to obtain a desired cutting angle on the cutting edge of the tool.

In accordance with the present invention, the abrasive stone is moved across the base plate while the cutting edge of the tool is in contact with the stone at a precise angle and with a precise amount of pressure between the cutting edge of the tool and the abrasive stone. In this way, material is removed from the cutting tool so as to enable a sharpening of the cutting edge of the tool. The cutting edge of the tool is located to extend across the base plate so that it is sharpened when the abrasive element is moved across the base plate.

A biasing means, such as a torsion spring, is associated with the biasing frame to cause a biasing of the cutting edge of the tool into the abrasive element with a constant and uniform amount of pressure. In this case, the biasing frame has a forward end and a rearward end and is pivotally mounted at its rearward end. The spring-type biasing means causes the tool clamped in the tool holder, to be biased into contact with the abrasive element with a constant amount of pressure along the entire cutting edge of the tool. The amount of force with which the cutting edge of the tool is brought into contact with the abrasive element is adjustable in large increments as, for example, by changing the spring used to cause that force. In this case, the apparatus can be constructed so that different springs are easily interchangeable. For smaller continuous changes, the amount of pressure exerted by the spring on the biasing frame can be manually adjusted by merely rotating a knob which controls the spring pressure and thereby controls the amount of tension imposed by the spring. A large tension setting is used for coarse sharpening and fast metal removal while a low tension setting is used for fine finish honing.

The tool holder is releasably mounted on the biasing frame so that one type of tool holder may be substituted for another to enable sharpening of a different type of tool. Thus, for example, in one case, the tool holder may be designed for releasably retaining a chisel. Another type of tool holder may be used to releasably retain a router bit, or the like.

When a removed tool holder is reclamped to the biasing frame, the position of the tool being sharpened is exactly where it was before removal. This allows an inspection of how the sharpening is progressing.

The movement pattern of the abrasive stone or other abrasive element is not critical, although movement of the stone would frequently occur laterally with respect to the tool in a reciprocative pattern. However, some elliptical movement alone or in combination with a lateral movement might also result. Other movement patterns as desired could also be generated by the user.

The abrasive element, such as the abrasive stone, can be removably located in a stone holder which is moved with respect to the cutting edge of the tool. The abrasive stone is preferably fitted within a recess in this stone holder. The stone holder is preferred when the bottom surface of the stone is abrasive and not sufficiently smooth to be easily moved across the base of the apparatus. The stone holder is also used when it is desired to obtain a secondary or so-called "microbevel" on chisels and like tools. For this purpose, the abrasive stone can be adjustably positioned in the stone holder so that the height of the abrasive member may be varied. A shim, or like device, can be inserted into the recess so as to provide for the adjustable positioning of the surface of the abrasive stone. This micro-bevel, or secondary bevel, can be obtained by changing the angle between the chisel or other tool and the stone by removing the insert between the stone and its holder. The thickness of the insert determines the angle of the secondary bevel. This microbevel can be less than one degree.

Separate holders may be employed for other shapes of abrasive stones. Thus, for example, in the present invention, a separate stone holder can be provided for an abrasive stone used in the sharpening of router bits and like tools.

One of the important aspects of the present invention is the fact that the apparatus allows a party relatively inexperienced in the sharpening of cutting tools to obtain a precise cutting edge with a precise cutting angle. This is due to the fact that all of the variables are now fixed as, for example, the amount of pressure required between the abrasive element and the cutting edge of the tool, as well as the angle with which the cutting edge of the tool is brought into contact with the abrasive element. Accordingly, all that is required is for the user to move the abrasive stone relative to the cutting edge of the tool. The movement of the stone may also be mechanized by attaching the stone holder to something as simple as a jig saw clamped to the base plate.

This invention possesses may other advantages and has other purposes which will be made more fully apparent from a consideration of the forms in which it may be embodied. One of the forms of this apparatus and, for that matter, the associated method, is more fully described in the following detailed description, and more fully illustrated in the accompanying drawings. However, it is to be understood that these drawings, and the following detailed description, are set forth for purposes of illustrating and describing the general principles of the invention and are not to be taken in a limiting sense.

BRIEF DESCRIPTION OF THE DRAWINGS

Figure 1:
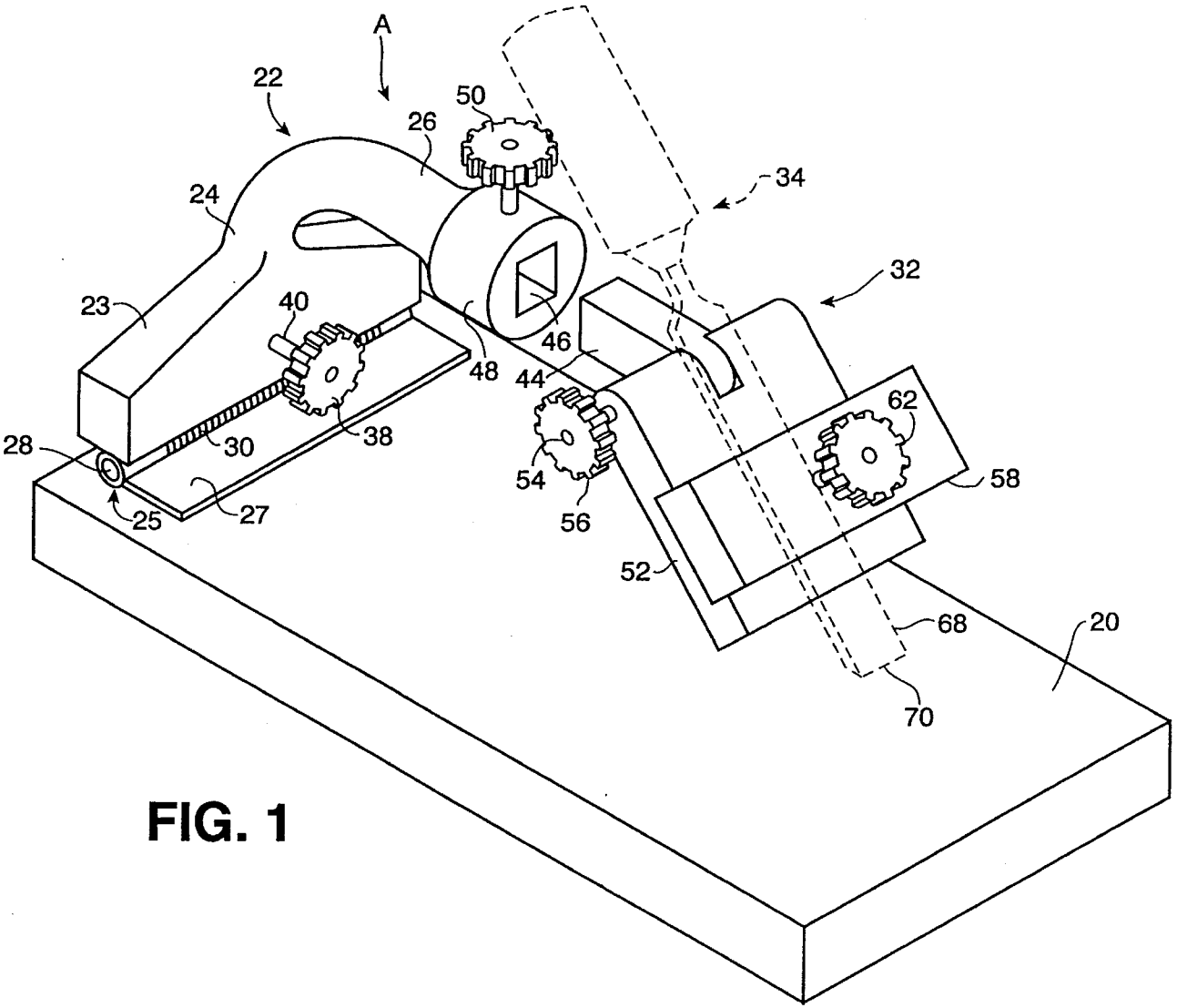
Figure 3:
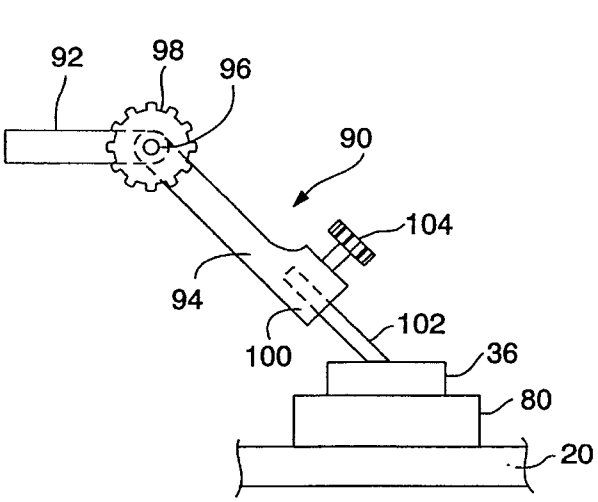
Figure 2:
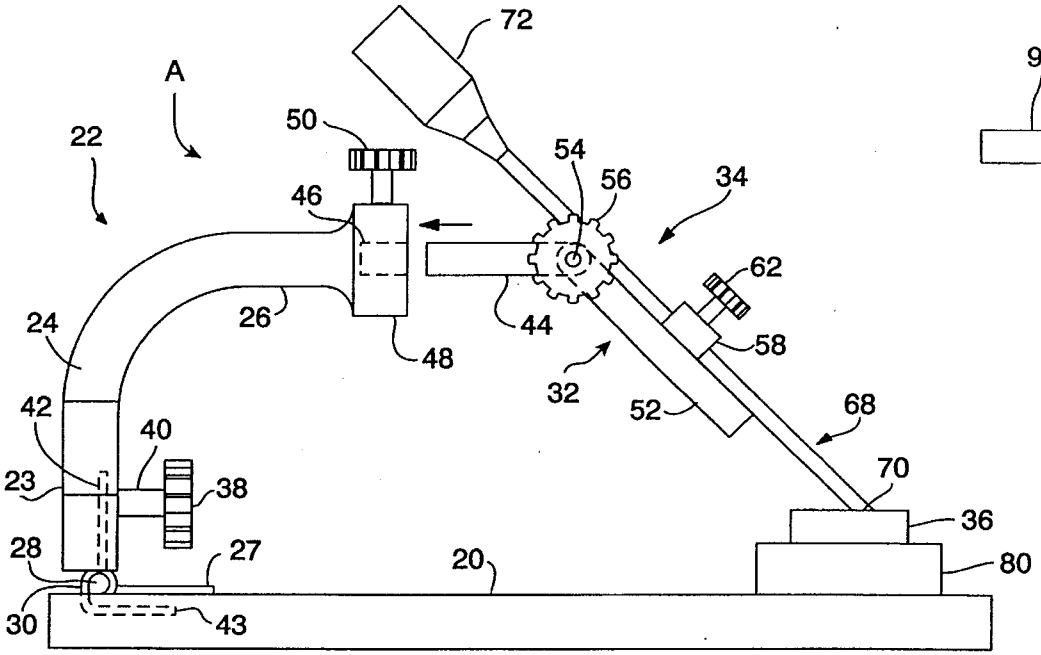
Figure 5:
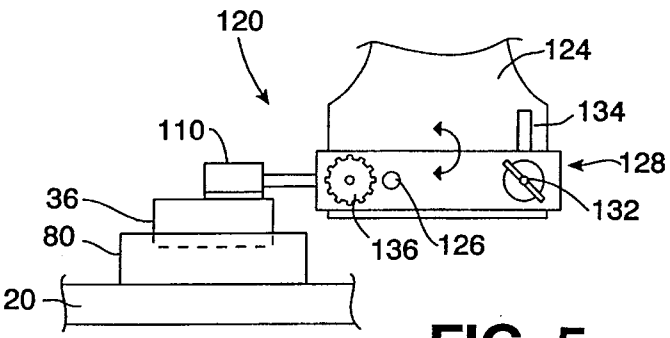
Figure 4:
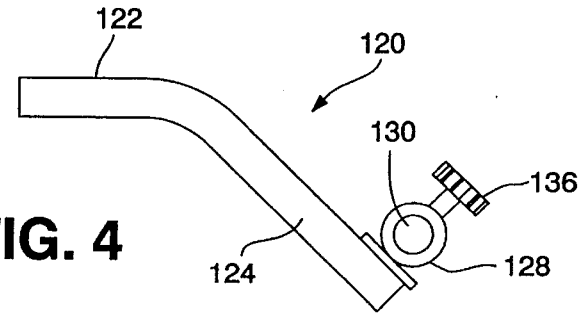

Having thus described the invention in general terms, reference will now be made to the accompanying drawings in which:

FIG. 1 is a perspective view of an apparatus for sharpening a cutting tool in accordance with and embodying the present invention;

FIG. 2 is a side elevational view of the apparatus of the invention and showing a cutting tool, e.g. a chisel, held by a tool holder forming part of the apparatus in an operative position with respect to an abrasive member;

FIG. 3 is a side elevational view of a modified form of tool holder forming part of the apparatus of the present invention for holding jointer knives or thickness planer knives;

FIG. 4 is a fragmentary side elevational view of a further modified form of tool holder used for holding a router bit;

FIG. 5 is a fragmentary front elevational view showing the use of the tool holder of FIG. 4 in a position where it is holding a router bit against an abrasive stone;

FIG. 6 is an exploded perspective view showing one form of an abrasive stone holder utilized with the apparatus of the present invention;

FIG. 7 is a vertical sectional view showing the assembled relationship of an abrasive stone mounted in the stone holder of FIG. 6 of the invention;

FIG. 8 is a side elevational view of an embodiment of the invention which utilizes a motorized means for shifting a stone holder;

FIG. 9 is an enlarged diagrammatic view showing the cutting edges of a router bit which may be sharpened with the apparatus of the present invention;

FIG. 10 is a fragmentary side elevational view of one form of wood cutting member, such as a chisel, which may be sharpened with the apparatus of the present invention; and FIG. 11 is a fragmentary side elevational view of a wood cutting member, such as a chisel, similar to FIG. 10, and which shows (in exaggeration for clarity) a secondary bevel thereon.

DETAILED DESCRIPTION OF A PREFERRED EMBODIMENT

Referring now in more detail and by reference characters to the drawings which illustrate practical embodiments of the present invention, A designates an apparatus for sharpening a cutting tool. In all cases, the sharpening will involve at least the honing, as previously described. Usually, honing, sharpening and grinding involve similar operations with the major distinction being the degree of sharpening which is performed on the cutting edge of the tool.

Some of the tools which can be honed and sharpened in accordance with the present invention are chisels, and plane blades, router bits, jointer knives, thickness planer knives, shaper cutters, molding cutter bits and some X-acto knife blades, etc. Further, the tools which can be sharpened in accordance with the present invention may be formed of carbide-tipped steel or solid carbide, such as router bits, etc.

The apparatus A generally comprises a base plate 20 and pivotally mounted on the base plate 20 is a biasing frame 22. The base plate 20 is preferably, although not necessarily, constructed of wood, including synthetic wood materials, such as plywood with a plastic laminate glued thereon, although any smooth material of construction may be used for this purpose.

By reference to FIGS. 1 and 2 of the drawings, it can be seen that the biasing frame 22 is comprised of a somewhat vertically arranged hinge mounting section 23 and a somewhat L-shaped section comprised of a somewhat vertically arranged leg 24 which integrally merges into a forwardly extending arm 26. The hinge mounting section 23 is pivotally secured to the base plate 20 with a hinge 25 having a rod or hinge pin 28 and a hinge plate 27 secured to the base plate 20. A torsion spring 30 cooperates with the hinge 25. The spring 30 may be coiled or U-shaped. The torsion spring 30 forces the biasing frame 22 and a tool holder 32, as hereinafter described, in a clockwise direction, reference being made to FIG. 2, to thereby force a tool 34 into contact with an abrasive stone 36, as hereinafter described in more detail.

The amount of pressure which the biasing frame forces the tool 34 against the stone 36, can be adjusted by means of an adjustment knob 38, mounted on the outer end of a threaded shaft 40 which is screwed into the section 23. The end of the shaft 40 bears against an end 42 of the torsion spring 30. Another end 43 of the spring is secured between the hinge plate 27 and the base plate 20. The end 42 of the spring is adjustable by shaft 40, as aforesaid, changing the angle between the spring ends 42 and 43. An increase in the angle between the spring ends 42 and 43 increases the spring pressure which thereby increases the amount of force which the spring imposes on the biasing frame toward the base.

It should also be understood that the spring 30 could be removed and a new spring, having a different spring constant, could be substituted therefor or replaced by multiple short spring segments to increase the force. This would vary the amount of pressure with which the tool is forced into contact against the abrasive stone. Other means for providing this biasing force and other means for adjusting the amount of the force could also be used.

Releasably secured to the forward end of the biasing frame 22 is one type of tool holder which is also more fully illustrated in FIGS. 1 and 2 of the drawings. This tool holder 32 is comprised of a rearwardly extending arm 44 which fits within an opening 46 of a socket 48 on the end of the arm 26, as shown. For this purpose, the opening 46 and the arm 44 would have the same cross sectional shape and preferably, this shape would be other than a circular shape so that the arm 44 would be in a proper orientation for insertion into the opening 46. A set screw 50 extends through the socket and engages the end of the arm 44 in the opening 46 to releasably lock the end of the arm 44 to the biasing frame 22.

In accordance with this construction, it can be seen that the tool holder 32 can be removed from the biasing frame 22 so that a different form of tool holder can be releasably attached to the biasing frame. Further, it should be understood that any effective type of releasable mounting mechanism could be used for releasably securing the tool holder to the biasing frame. When a tool is mounted in the tool holder and the tool holder is removed from the biasing frame for inspection of the tool edge during the sharpening operation, the tool holder, when reclamped, will reposition the tool precisely where it was before removal.

The tool holder is also comprised of a supporting plate 52 which is pivotally secured to the forwardmost end of the arm 44, that is, the right-hand end, reference being made to FIG. 2, through a pivot pin 54. A knurled knob 56 is mounted at an outer end of the pivot pin 54 and through this construction, it is possible to adjust the angle of the support plate 52 with respect to the arm 44. Tightening of the knob 56 clamps the arm 44 rigidly to the supporting plate 52. As a result, the user of the apparatus can adjust the angle of the tool 34 with respect to the abrasive stone 36. A clamp in the form of a U-shaped bracket 58 is attached to the support plate 52 and with a set screw 62 will releasably lock the shank of the tool 34 in a fixed position on the support plate 52. Other means of adjusting the angle of the tool's cutting edge or clamping the tool to the tool holder could also be used.

In the embodiment of the apparatus, as shown in FIGS. 1 and 2, the tool which is being sharpened is a chisel. However, any of the other tools, as previously described, could also be mounted on an appropriate tool holder for being held in a fixed relationship to the abrasive stone 36.

The hinge pin 28 is easily removable from its pivotal connection between the biasing frame 22 and the base plate 20. This allows the torsion spring 30 to be easily removed and a new torsion spring substituted therefor. In this way, it is possible to readily and easily achieve large increment changes in the amount of force used to spring bias the forward end of the tool holder 32 and the tool carried thereby toward the abrasive stone 36, as hereinafter described. For smaller and continuous changes in the force, the knob 38 is rotated.

In accordance with the present invention, it is now possible to adjust the angle with which the cutting edge of the tool is forced against the abrasive stone. Moreover, this angle, often referred to as the angle of attack, is easily adjustable by the operator of the apparatus by merely positioning the support plate 52 at a desired angle with respect to the arm 44. In this way, the angle of the cutting edge of the tool can be varied at the will of the operator. Not only can the proper angle of the cutting edge be obtained, but it can be precisely obtained. This, in combination with the adjustability of the amount of pressure which exists between the tool's cutting edge and the abrasive element, provides a wide degree of versatility to the apparatus and enables the operator to obtain precisely the type of cutting edge on the tool which is desired. Moreover, this also lends to accurate reproduction of sharpening of the tool's cutting edge in subsequent sharpening operations.

One form of cutting tool 34 is a chisel, as illustrated in FIG. 10. It can be observed that the chisel has a shank 68 and a cutting edge 70. Further, the upper end of the shank 68 is provided with a handle 72 (FIG. 2) to be engaged by the user of the chisel. The exact form of the tool is not critical and other types of tools may be sharpened, in accordance with the present invention, as heretofore described.

FIG. 2 more fully illustrates the position of the tool 34, such as the chisel with its cutting edge 70 against the upper surface of the abrasive stone 36. As the abrasive stone is moved, either manually or by motorized movement (as hereinafter described), some material is removed from the edge 70 of the tool 34 and which results in a sharpening action.

Any number of abrasive stones may be used with the apparatus of the present invention, including, for example, diamond hones, natural or synthetic water or oil stones, grinding wheels and the like. Generally, any stone which is used in conventional sharpening operations may also be employed in the apparatus of the present invention.

The surface of the base plate 20 is smooth and if the underside of the abrasive stone 36 is also smooth and not abrasive, the stone can be shifted directly on the base plate 20. However, if the underside of the stone is abrasive, the stone is placed in a holder 80 for movement on the base plate 20.

The abrasive stone 36 may be inserted into a recess 82 in the holding block or holder 80 with the recess 82 having the size and shape of the abrasive stone 36, as shown in FIG. 6. An insert 84 may also be used to raise the stone 36 in order to achieve a bevel or so-called "microbevel" 86, as shown in FIG. 11. The honing of the tool's cutting edge to obtain a secondary bevel, such as the bevel 86, is usually performed on chisels or hand plane blades. It should be understood that the secondary bevel, as shown in FIG. 11, is exaggerated in size only for purposes of clarity. The secondary bevel 86 could have an angle of less than one degree from that of the cutting edge 70. Again, the thickness of the insert 84 determines the angle of the secondary bevel.

When forming the secondary bevel on the edge of the tool, the insert 84 is located in the stone holder 80 in order to enable the sharpening of the cutting edge 70. Thereafter, the insert 84 is removed and sharpening is again continued until the microbevel 86 is formed.

FIG. 3 illustrates a modified form of tool holder 90 which is particularly useful in the sharpening of jointer knives and thickness planer knives. This tool holder 90 is similar to the previously described tool holder 32, and includes an arm 92 which can be fitted within the opening 46 of the socket 48 and locked therein by means of the set screw 50. A retaining arm 94 is pivotally secured to the outer end of the arm 92 through a pivot pin 96, for adjusting the angular position of the retaining arm 94 with respect to the abrasive stone 36. Tightening of a knob 98 clamps the arm 92 rigidly to the arm 94. The outermost end of the retaining arm 94 is also provided with a socket 100 for releasably mounting a jointer knife or planer knife 102, as shown in FIG. 3. A set screw assembly 104 is provided for releasably locking the tool in the socket 100, as also shown in FIG. 3. Due to the width of jointer knives and especially thickness planer knives, the socket 100 is long and multiple set screws 104 may be used. Beyond this, the tool holder 90 of FIG. 3 operates in the same manner as the previously described tool holder. Further, the angle at which the cutting edge of the tool bears against the abrasive stone, as well as the amount of force with which the cutting edge is forced onto the abrasive stone, is adjustable in the manner as previously described.

FIG. 9 shows an end elevational view of a carbide tipped router bit 110, having a circular shank 112. Located in recesses 114 of the shank 112 are carbide cutting sections 116, having cutting edges 118, as shown. These edges 118 require sharpening and typically only fine sharpening such as honing.

FIGS. 4 and 5 illustrate an embodiment of a tool holder 120 used for holding router bits, such as the router bit 110, against the abrasive stone 36. The tool holder 120 is provided with an arm 122 which fits within the opening 46 of the socket 48 and can be locked therein through the set screw arrangement 50. The arm 122 is bent, as shown in FIG. 4, and is provided with a downwardly struck leg 124. Mounted on the lower end of leg 124 for pivotal movement about a pivot pin 126, as shown in FIG. 5, is a router bit mounting tube 128, having an internal bore 130 for removably receiving a router bit 110. The router bit 110 is rotated in the bore 130 so that the cutting edge 118 is properly positioned against the abrasive stone 36 so that the cutting section 116 is parallel to and rests on the abrasive stone.

The exact angular position of the router bit 110 with respect to the leg 124 can be changed by pivotally changing the position of the mounting tube 128. A wing nut 132 is used for locking the mounting tube 128 in a fixed position so that the edge of the router bit 110 is held in a fixed and desired angular position against the surface of the abrasive stone 36. The locking mechanism consists of a wing nut 132 and a T-bolt which moves in an elongate slot 134 formed in the arm 124, as best shown in FIG. 5 of the drawings.

The reason for the router bit mounting tube 128 being pivotal is for the sharpening of shear action cutting bits. The cutting edges of these bits are straight, but are not parallel to the axis of the bit.

A set screw mechanism 136 is also provided for releasably locking the shank of the router bit 110 in the mounting tube 128. Thus, the tool holder of FIGS. 4 and 5 allows for the sharpening of tools, such as router bits. Other router bit mounting means and other angular positioning means could also be used.

It can be understood that there are a variety of other cutting members which require sharpening from time to time. The apparatus and the associated method of the invention are highly effective in sharpening these edges. Further, the apparatus and method of the invention are effective in sharpening router bits, as aforesaid, as well as solid carbide and carbide-tipped cutting tools. Due to the fact that the cutting edge of the tool can be brought into contact with an abrasive stone and held in a precise position and with a fixed amount of force, the apparatus enables an individual relatively unskilled in sharpening to easily perform a precise and accurate sharpening operation by simply moving the stone back and forth.

FIG. 8 illustrates an arrangement in which the stone holder 80 can be shifted laterally in a reciprocative path by a motorized mechanism 140. This motorized mechanism 140 may constitute a simple jigsaw motor. The stone holder 80 would be provided with an arm 142 for mounting in the jigsaw motor mechanism, much in the same manner as a jigsaw blade would mount. Thus, if the jigsaw motor 140 were mounted to the base 20, the stone holder 80, and hence the abrasive stone 36 would be shifted laterally in a reciprocative path under the cutting edge of the tool. Other means for providing motorized movement of the stone holder can also be used.

Thus there has been illustrated and described a unique and novel apparatus for sharpening the edge of a cutting member and which thereby fulfills all of the objects and advantages which have been sought. It should be understood that many changes, modification, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. Apparatus for sharpening a cutting tool, said apparatus comprising:

(a) a base plate;

(b) a biasing frame having front and rear ends;

(c) a tool holder secured to the front end of said biasing frame for releasably holding in a stationary position a cutting tool having a cutting edge which is to be sharpened, said tool holder having an adjustment means so that the angle of the cutting edge of the tool can be adjusted relative to an abrasive member, said tool holder being releasably mounted to said biasing frame, said rear end of said biasing frame being pivotably mounted to said base plate enabling said front end of said biasing frame to be movable towards and away from said base plate;

(d) means enabling an abrasive member to be moved with respect to the cutting edge of the tool when said edge of said cutting tool is held against the abrasive member to thereby enable a sharpening of the cutting tool edge;

(e) an adjustable biasing means for automatically and continuously biasing the edge of the cutting tool against the abrasive member with a substantially uniform predetermined pressure along the entire cutting edge of the tool, whereby said tool is held with the predetermined pressure against the abrasive member; and (f) wherein said adjustable biasing means comprises resilient means connecting the rear end of said biasing frame to said base plate.

2. Apparatus for sharpening a cutting tool, said apparatus comprising:

(a) a base plate;

(b) a biasing frame having front and rear ends;

(c) a tool holder secured to the front end of said biasing frame for releasably holding in a stationary position a cutting tool having a cutting edge which is to be sharpened, said tool holder having an adjustment means so that the angle of the cutting edge of the tool can be adjusted relative to an abrasive member, said tool holder being releasably mounted to said biasing frame, said rear end of said biasing frame being pivotably mounted to said base plate enabling said front end of said biasing frame to be movable towards and away from said base plate;

(d) means enabling an abrasive member to be moved with respect to the cutting edge of the tool when said edge of said cutting tool is held against the abrasive member to thereby enable a sharpening of the cutting tool edge;

(e) an adjustable biasing means for automatically and continuously biasing the edge of the cutting tool against the abrasive member with a substantially uniform predetermined pressure along the entire cutting edge of the tool, whereby said tool is held with the predetermined pressure against the abrasive member: and (f) wherein said abrasive member is moved laterally with respect to the cutting edge of the tool in a reciprocative manner.

* * * * *